United States Patent [19]

Schlacher

[11] 4,148,423

[45] Apr. 10, 1979

[54] SHOULDER STRAP FOR MUSICAL INSTRUMENT

[75] Inventor: Rudolf W. Schlacher, Riverwoods, Ill.

[73] Assignee: Fretted Industries, Incorporated, Evanston, Ill.

[21] Appl. No.: 810,635

[22] Filed: Jun. 27, 1977

[51] Int. Cl.[2] ..... G10G 5/00

[52] U.S. Cl. ..... 224/258; 84/280; 84/327; 224/910

[58] Field of Search ..... 224/5 R, 5 A, 5 B, 5 N, 224/5 P, 5 S, 5 Z; 84/280, 327

[56] References Cited

U.S. PATENT DOCUMENTS

| | | | |
|---|---|---|---|
| 2,643,039 | 6/1953 | Sottile | 224/5 S |
| 2,808,973 | 10/1957 | Gobble | 224/5 P |
| 3,323,698 | 6/1967 | Sottile | 224/5 S |
| 3,688,012 | 8/1972 | Vettel | 224/5 S |
| 3,799,413 | 3/1974 | McBain | 224/5 P |

*Primary Examiner*—Trygve M. Blix
*Assistant Examiner*—Winston H. Douglas
*Attorney, Agent, or Firm*—Fulwider, Patton, Rieber, Lee & Utecht

[57] ABSTRACT

A novel shoulder strap is provided for holding a musical instrument or the like. The strap comprises an elongated piece of material adapted to be attached to said instrument near each end of the strap, the strap being curved laterally to conform to the user's shoulder.

4 Claims, 2 Drawing Figures

SHOULDER STRAP FOR MUSICAL INSTRUMENT

BACKGROUND AND SUMMARY OF THE INVENTION

The present invention relates generally to shoulder straps for holding heavy objects in front of a person. More specifically this invention relates to a shoulder strap for holding a musical instrument in a playing position.

Prior art straps have always been formed in a straight line. As a result, when the strap was placed over a user's shoulder, the strap would exert more pressure on one side of the strap than the other. This caused discomfort for the user, especially when the strap was used to hold a particularly heavy object for an extended length of time.

It is the object of this invention to provide a shoulder strap which overcomes the difficulties encountered heretofore. This is accomplished by providing a shoulder strap adapted to be attached to an object near each end of the strap, the strap being curved laterally intermediate the ends to conform to the user's shoulder.

DESCRIPTION OF THE PREFERRED EMBODIMENT

Figure 1:
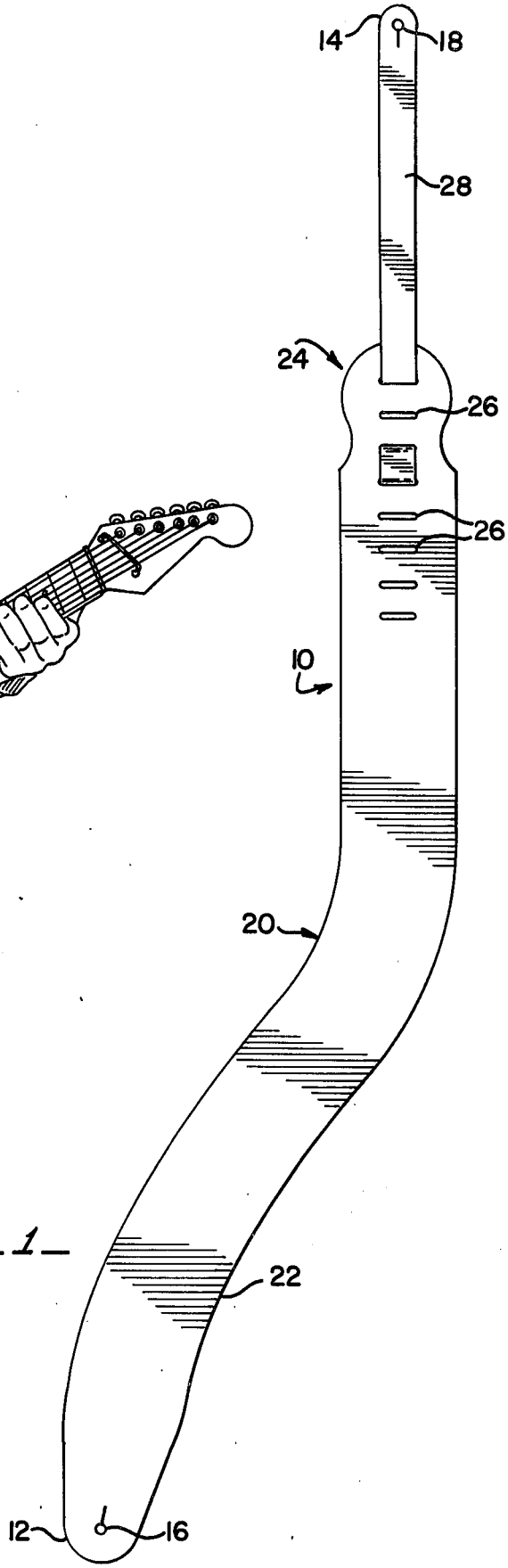
FIG. 1 is a view of the strap of the present invention as though laid out in a plane.

Referring first to FIG. 1, the strap of the present invention is shown generally at 10 as though laid out in a plane. The strap is a relatively flat, elongated piece of material. It terminates in a front end 12 and a rear end 14. Each end is adapted to be attached to the object to be held by the user. In this instance the front end 12 has a hole and slot 16, and the rear end 14 has a similar hole and slot 18 for that purpose.

Intermediate the ends 12 and 14 the strap curves laterally in the plane in which it is shown as at 20. The strap is curved to form an acute angle with a forward extension of the longitudinal axis of the rear portion of the strap. This angle may be between about 20 and 60 degrees, and is preferably between about 30 and 45 degrees. In some instances it has been found advantageous to construct the strap so that it recurves laterally in a direction opposite the curve 20 between the curve 20 and the front end 12 as at 22.

The strap may be constructed of any relatively flexible material having sufficient tensile strength to support an object which is to be held by a person. Various materials have been found to be satisfactory for this purpose, but the preferred material is leather.

While it is not necessary for the purposes of this invention, the strap may be provided with an adjustable means at one end, preferably the rear end. A typical adjustment means is shown generally at 24 and comprises a series of slots 26 provided in the strap 10 and an adjusting extension 28 which is secured to the strap 10 through slots 26. This preferred means for adjusting the overall length of the strap has not been shown or described in detail because its construction and use is well known in the art.

It should be noted that the adjustment means is not essential to the proper function of the instant invention. If the adjustment is used, the hole and slot 18 is located in the rear end of the adjusting extension 28. If the adjustment means is not used, the hole and slot 18 is located in the rear end of the strap 10.

Figure 2:
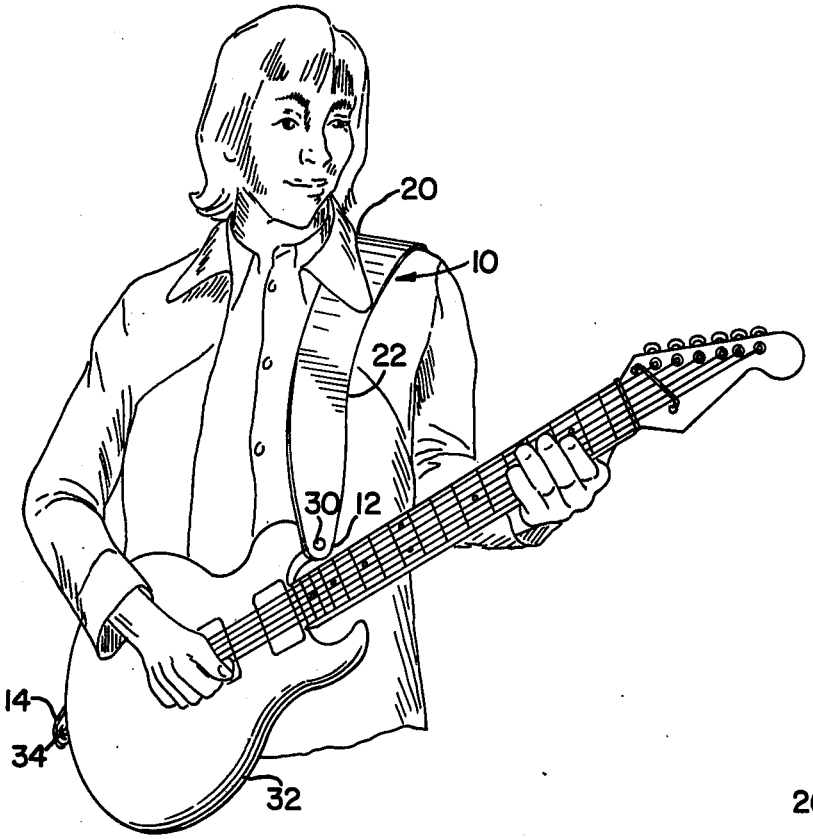
FIG. 2 is an illsutration of the strap of the present invention as normally used.

Referring now to FIG. 2, the strap 10 is shown as normally used. The front end 12 is attached to a peg 30 on the object to be held 32. The rear end 14 is similarly attached to a peg 34 also on the object 32. The object 32 has been illustrated as a guitar, but it is understood that the present invention is suitable for holding any object which may be similarly attached. Moreover, the means for attaching the strap 10 to the object 32 has been illustrated as a hole and slot 16 or 18 fitted about a peg 30 or 34. It is understood that any means known in the art for attaching a strap to an object is within the scope of this invention.

The strap 10 is so constructed that the curve 20 bears upon the shoulder of the user. The curvature 20 causes the strap to conform to the contour of the user's shoulder thereby distributing the weight of the object 32 evenly across the width of the strap 10.

In some instances it is advantageous to recurve the strap 10 as at 22 to facilitate fastening the front end 12 to the object 32. Thus it will be seen that the strap 10 is formed of three generally straight portions; the first portion extending from the rear end 14 to the first lateral curve 20, the second portion extending from the curve 20 to the oppositely directed second curve 22, and the third portion extending from the second curve 22 to the front end 12.

I claim:

1. In a shoulder strap for holding a musical instrument comprising an elongated piece of material adapted to be attached to said instrument near each end of said strap; the improvement wherein said strap comprises:

a first generally straight portion adjacent one end of said strap and having a first longitudinal axis;

a second generally straight portion extending from one end of said first portion and having a second longitudinal axis which forms an acute angle with an extension of said first longitudinal axis thereby forming a first lateral curve with respect to said first portion to conform to a user's shoulder; and a third generally straight portion extending from one end of said second portion and having a third longitudinal axis which forms a second angle with an extension of said second longitudinal axis thereby forming a second lateral curve with respect to said second portion in a direction opposite that of said first lateral curve.

2. A shoulder strap as defined in claim 1 further characterized in that the angle through which said first lateral curve passes is between about 20 and 60 degrees.

3. A shoulder strap as defined in claim 1 further characterized in that the angle through which said first lateral curve passes is between about 30 and 45 degrees.

4. A shoulder strap as defined in claim 1 further comprising a means for adjusting the length of said strap in order to properly locate said first lateral curve with respect to said user's shoulder.

* * * * *